US007775492B2

(12) United States Patent
Pierzynski et al.

(10) Patent No.: US 7,775,492 B2
(45) Date of Patent: Aug. 17, 2010

(54) MOUNTING SYSTEM AND APPARATUS FOR ATTACHING ACCESSORIES TO A WALL PANEL

(75) Inventors: Timothy M. Pierzynski, Apple Creek, OH (US); Erik L. Skov, Akron, OH (US)

(73) Assignee: Rubbermaid Incorporated, Huntersville, NC (US)

( * ) Notice: Subject to any disclaimer, the term of this patent is extended or adjusted under 35 U.S.C. 154(b) by 784 days.

(21) Appl. No.: 11/232,733

(22) Filed: Sep. 22, 2005

(65) Prior Publication Data

US 2006/0067661 A1 Mar. 30, 2006

Related U.S. Application Data

(60) Provisional application No. 60/611,969, filed on Sep. 22, 2004.

(51) Int. Cl.
*A47B 96/06* (2006.01)
*A47F 5/08* (2006.01)

(52) U.S. Cl. ..... 248/220.43; 248/220.41; 248/223.41; 211/87.01

(58) Field of Classification Search ..... 248/220.22, 248/220.41, 220.43, 221.11, 223.41, 222.54, 248/225.11, 243, 220.42, 224.51, 224.61, 248/223.21; 211/90, 70.6, 69.5, 87.01, 94.01, 211/57.01

See application file for complete search history.

(56) References Cited

U.S. PATENT DOCUMENTS 2,788,902 A * 4/1957 Nowicki ..... 248/243
4,212,445 A * 7/1980 Hagen ..... 248/223.41
4,474,351 A * 10/1984 Thalenfeld ..... 248/220.22
4,688,683 A * 8/1987 Thalenfeld et al. ..... 211/57.1
4,805,365 A * 2/1989 Bastian ..... 52/282.2
4,895,331 A * 1/1990 Nehls ..... 248/245
5,356,104 A * 10/1994 Rosenberg et al. ..... 248/223.41
5,456,435 A * 10/1995 Sweeney ..... 248/250
5,645,177 A * 7/1997 Lin ..... 211/70.6
5,707,033 A * 1/1998 Holt et al. ..... 248/225.11
5,931,429 A * 8/1999 Hellwig et al. ..... 248/220.22
6,105,794 A * 8/2000 Bauer ..... 211/94.01
6,189,489 B1 * 2/2001 Pearce ..... 119/477
6,601,808 B1 * 8/2003 Nagel ..... 248/220.31
6,668,514 B2 12/2003 Skov ..... 52/782.1
6,698,124 B2 * 3/2004 Kump et al. ..... 248/220.41
6,701,678 B1 3/2004 Skov et al. ..... 52/79.9
6,827,320 B2 * 12/2004 Yeh ..... 248/220.22
7,334,763 B1 * 2/2008 Rice ..... 248/224.7
7,427,053 B2 * 9/2008 Nawrocki ..... 248/220.21
2002/0174532 A1 11/2002 Skov et al. ..... 29/453
2006/0067661 A1 * 3/2006 Pierzynski et al. ..... 396/71

* cited by examiner

*Primary Examiner*—Amy J Sterling
*Assistant Examiner*—Tan Le
(74) *Attorney, Agent, or Firm*—Dennis J. Williamson; Moore & Van Allen, PLLC

(57) ABSTRACT

A mounting apparatus has a wall panel accessory with at least one connector projecting from a portion of the accessory. The connector has a groove formed in a surface of the connector. A mounting body has a front and a back. At least one connector receptacle extends into a surface of the body and the connector is releasably received in the connector receptacle. A releasable retainer protrudes into the groove of the connector. A wall mounting projection extends from the back of the body and is configured to slidably mount in a channel in a wall panel.

17 Claims, 10 Drawing Sheets

MOUNTING SYSTEM AND APPARATUS FOR ATTACHING ACCESSORIES TO A WALL PANEL

RELATED APPLICATION DATA

This patent claims priority benefit of an earlier filed U.S. Provisional Application Ser. No. 60/611,969, entitled Mounting Method and Device for Attaching Accessories to a Wall Panel, and filed on Sep. 22, 2004.

BACKGROUND OF THE INVENTION

1. Field of the Disclosure

The present disclosure is generally directed to attaching accessories to a wall panel, and more particularly to a system and apparatus for mounting accessories such as storage devices to a wall panel.

2. Description of Related Art

The need and means to organize a shed or other storage space is a continuing need for consumers. Storage sheds typically have relatively small storage spaces. One type of shed has molded wall panels with vertical grooves in the interior wall surfaces. The grooves in the interior wall panels are provided for interconnecting adjacent wall panels and/or for mounting objects to the wall panels. Such wall panel constructions, attachment methods, and general configurations for mounting objects to the walls are disclosed in prior issued U.S. Pat. Nos. 6,701,678 and 6,668,514, as well as (soon to be issued) U.S. application Ser. No. 10/127,949. Each of these patents is assigned to the assignee of the present invention and each is hereinafter incorporated herein in its entirety.

There are other well known wall panel accessory mounting devices for mounting storage items, tool holders, shelves, baskets, and the like to a wall. For example, walls with a peg board or perforate wall panel configuration have long been known in the art. Mounting brackets and other accessory configurations have also long been known and specifically devised to be attachable to such a peg board wall configuration.

There is a continuing need to improve upon mounting techniques for storage spaces and the like and to improve upon space utilization within such spaces.

BRIEF DESCRIPTION OF THE DRAWINGS

Objects, features, and advantages of the present invention will become apparent upon reading the following description in conjunction with the drawing figures, in which.

DETAILED DESCRIPTION OF THE DISCLOSURE

The present invention is directed to a mounting apparatus and system for attaching storage devices and other accessories to a wall panel. In one example, the wall panel is a shed wall and includes vertical channels formed in the wall. The channels can be constructed to slidably receive a projection carried on a portion of an assembled accessory. The projection can be received through a first section of the channel and slid, for example, downward into a narrower or second section of the channel. The projection can be configured such that it is retained in the second section of the channel in the wall panel. Examples of such a wall panel and projection construction are disclosed in U.S. Pat. Nos. 6,701,678 and 6,668,514, as well as (soon to be issued) U.S. application Ser. No. 10/127,949, as noted above.

The storage devices or other accessories that can be mounted to a wall panel using the apparatus and system of the present invention can vary considerably and yet fall within the spirit and scope of the present invention. The accessory devices can encompass a wide variety of different hardware and storage devices. The accessory devices can be utilized to store, hold, support, organize, or otherwise provide utility for a storage space. Each storage device or accessory is configured to connect to a mounting apparatus which in turn carries the projection for attaching the apparatus and accessory to the wall panel. Examples of various accessory devices and mounting apparatus and systems are disclosed and described in this patent. In one example, a system can be provided having an array of different accessories that can be chosen by a consumer to suit their storage space needs. In such an example, the mounting components are common to all of the accessories in the array.

Figure 1:
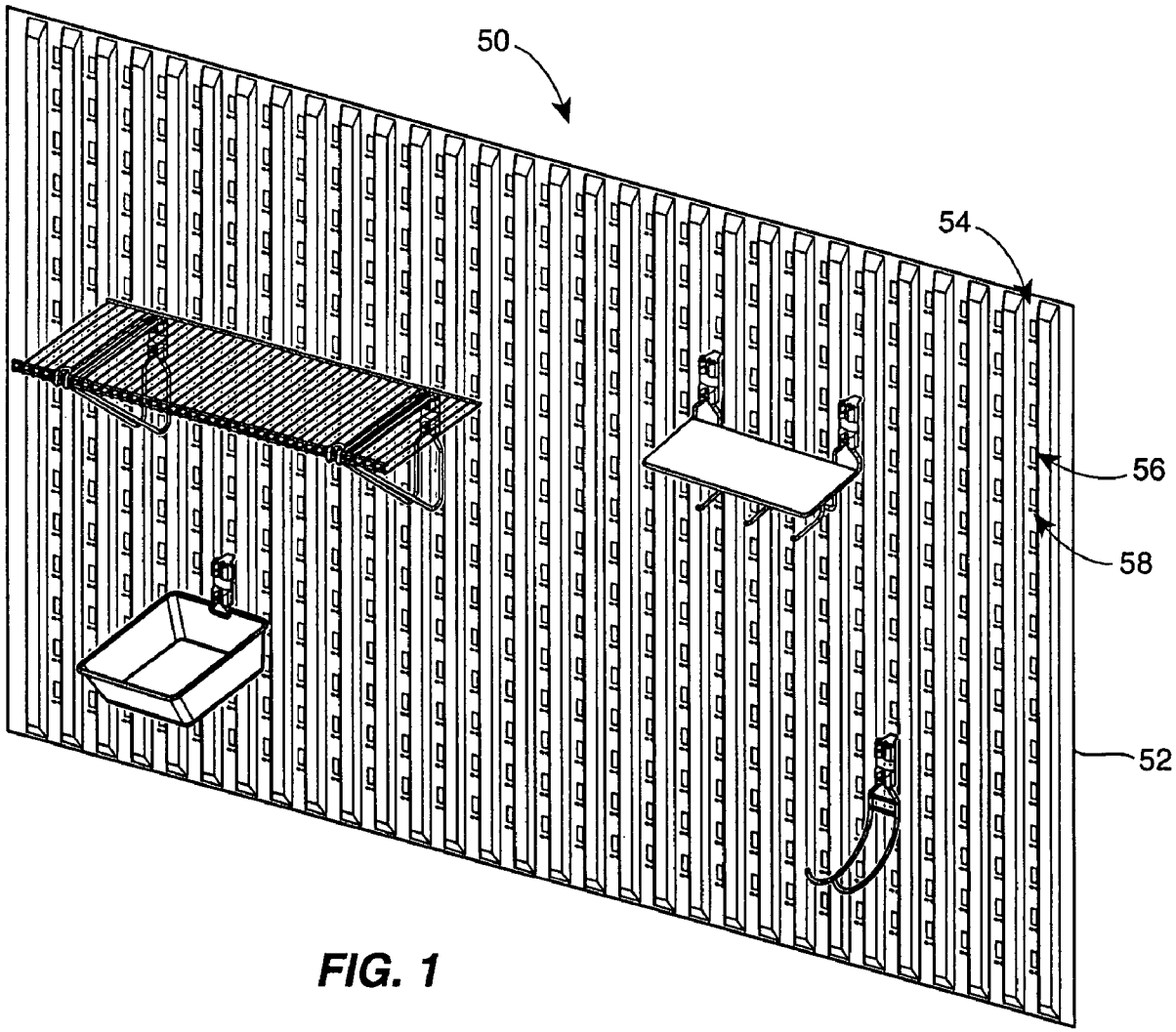
FIG. 1 shows a perspective view of a wall panel with a number of examples of storage accessories mounted to the panel using a mounting system and apparatus constructed in accordance with the teachings of the present invention.

Turning now to the drawings, FIG. 1 shows a perspective view of one example of a wall panel assembly 50 constructed in accordance with the teachings of the present invention. In the disclosed example, a wall panel structure 52 can be a blow molded, hollow, plastic panel with a plurality of vertically oriented channels 54 or channel segments. The channels 54 in the panel can have, as in the above noted patents, two channel sections including a docking or receiving section 56 and a mounting or locking section 58. A number of generic storage accessory devices are shown in FIG. 1 mounted to the wall panel 52.

A number of specific examples of accessory devices are described below and shown in greater detail in the drawings. FIG. 1 is shown merely to illustrate the general environment for the mounting arrangement of accessories as disclosed herein. The specific channel constructions and configurations suitable for the disclosed examples of the mounting apparatus embodiments described herein are shown and described in more detail in the above-noted issued patents assigned to the assignee of the present invention. The channel construction is not described and disclosed herein. Instead, the teachings of the earlier issued patents are incorporated herein by reference in the entirety.

The mounting apparatus disclosed herein includes three basic components: a mounting body; connectors or prongs carried by the accessories that mate with the mounting body; and a releasable retainer that secures the connectors in the mounting body. Examples of these components are described successively below. In a second example of FIGS. 10-18, one or more set screws can also be used as part of the apparatus. The set screws can be employed to secure in place the retainers in the form of slugs. A first example of the apparatus as shown in FIGS. 2-9 and 18 does not employ set screws. Instead, a slight interference or friction fit can be employed to hold the slugs in place.

Figure 2:
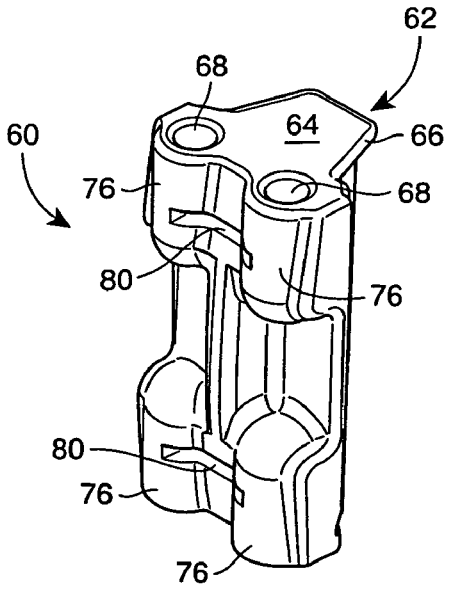
FIG. 2 is a front perspective view of one example of a mounting body part of the system and apparatus depicted in FIG. 1 and constructed in accordance with the teachings of the present invention.

FIGS. 2-9 illustrate various views and sections of one example of a mounting body 60 constructed in accordance with the teachings of the present invention. FIG. 2 shows a perspective view of the mounting body 60. The body 60 is somewhat elongate and has a longitudinal axis A. When in use, the axis A is typically vertically oriented. However, other orientations are certainly within the scope and spirit of the present invention. For ease of description herein, and representative of the typical orientation for the disclosed body, the terms top, bottom, front, and back are used. However, these terms are not intended to be specifically limiting in nature as used herein. Instead, these terms are used to relate various components and component portions to one another.

The disclosed mounting bodies include two optional accessory attachment locations, one on the top and one on the bottom. The invention is not intended to be limited to only two locations. It is certainly possible to provide a mounting body with only one accessory attachment location or with three, four, or even more accessory attachment locations, depending upon the size and shape of the mounting body.

A top end 62 of the body 60 has a generally flat, truncated, somewhat triangular face 64 in this example. A lip 66 extends rearward at the truncated portion of the face 64 and can acts as a stop to prevent further vertical downward insertion of the body into a channel or groove in the wall panel. The lip 66 in this example is optional, as is the particular shape of the face 64 and configuration of the top end 62.

A pair of upward opening connector receptacles or bores 68 is provided extending down into the body from the top face 64. In this example, the bores are blind and have closed bottom ends, although the bores need not be blind. However, in this example the blind bottoms serve the purpose of positioning a connector as is described below. As an alternative, inwardly projecting steps, ribs, tabs, or the like can be provided within the receptacles or bores to act as travel limiters or stops.

Figure 9:
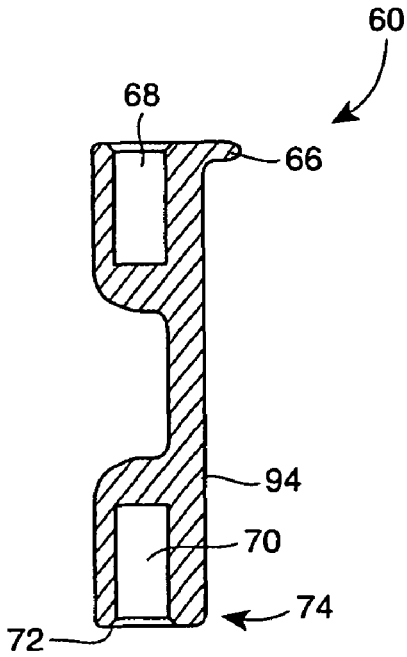
FIG. 9 is a cross section taken along line B-B of the mounting body shown in FIG. 4.

The mounting body 60 has a pair of similarly positioned and spaced apart connector receptacles or bores 70 extending upward in a bottom face 72 in a bottom end 74 of the body. These bottom bores 70 are depicted in cross section in FIG. 9. In this example, as shown in FIGS. 2 and 9, the top and bottom bores 68 and 70 are provided in protrusions 76 extending forward from the elongate body. Each of the receptacles or bores terminates significantly less than one half the height of the mounting body. The mid-section of the elongate body between the bores has a thinner profile for material savings in this example.

Figure 4:
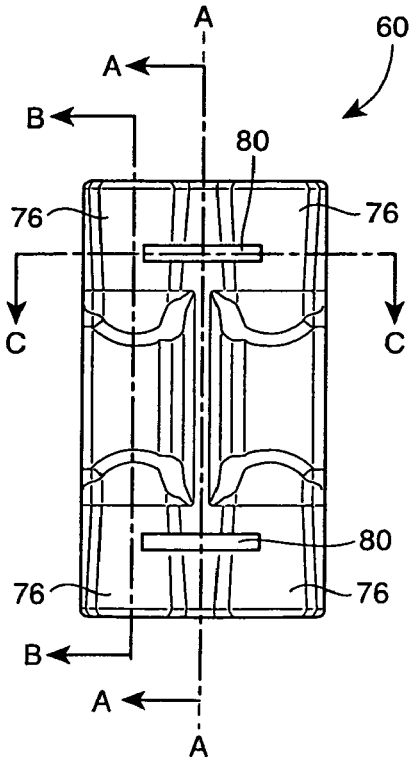
FIG. 4 is a front view of the mounting body shown in FIG. 2.
Figure 8:
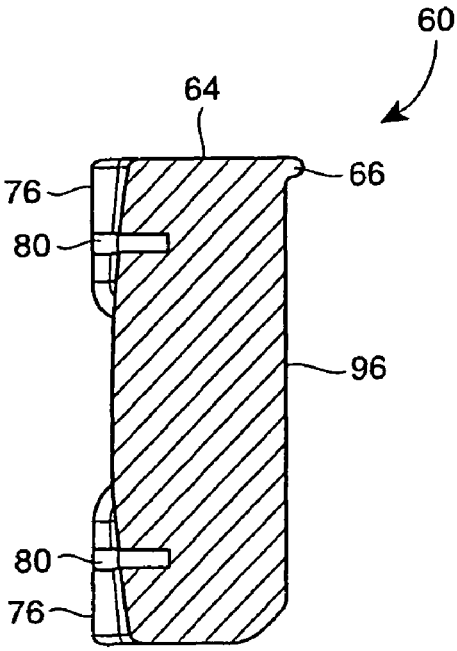
FIG. 8 is a cross section taken along line A-A of the mounting body shown in FIG. 4.

As shown in FIGS. 2, 4 and 8, a pair of forward opening slots or ways 80 is provided in the front of the mounting body. Each slot 80 laterally traverses between and partially extends or impinges upon the cylinder of a respective pair of the bores 68 and 70. Thus, one slot is positioned near each of the top end and the bottom end of the body 60. Each slot or way 80 is configured such that a slug or key (described below) can be inserted in the slot or way to hold or lock a connector or prong (also described below) of an accessory device in each bore, one installed in the mounting body. In this example, each slot 80 is essentially a flat, linear opening in cross section.

Figure 3:
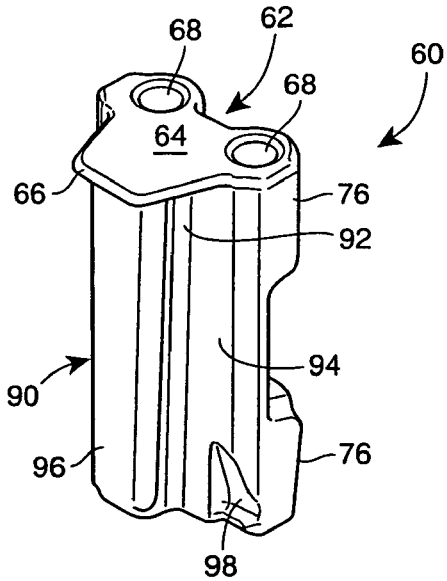
FIG. 3 is a rear perspective view of the mounting body shown in FIG. 2.
Figure 5:
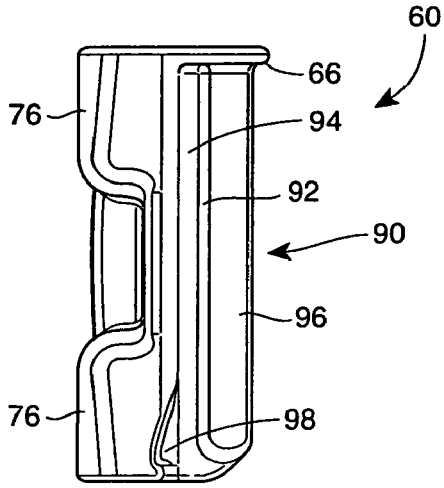
FIG. 5 is a side view of the mounting body in FIG. 2.
Figure 6:
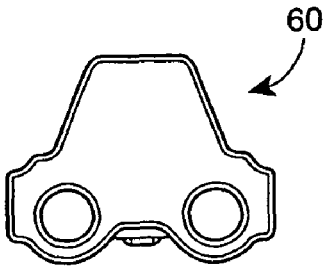
FIG. 6 is a top view of the mounting body shown in FIG. 2.
Figure 7:
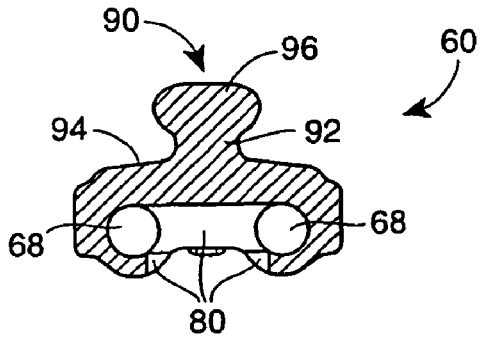
FIG. 7 is a cross section taken along line C-C of the mounting body shown in FIG. 4.

In this example, as shown in FIGS. 3, 5, and 7, each mounting body 60 has a rearward extending projection 90. The projections 90 are for slidably mounting the body 60 to a wall panel. In this example, the mounting projection takes the form of a vertically oriented, elongate dovetail projection that protrudes from the back of the body. The projection is aligned with the longitudinal axis A of the mounting body 60 in this example. The dovetail projection 90 has an elongate stem portion 92 connecting to the rear surface 94 of the body. The stem 92 terminates at an elongate head 96. The head 96 is wider in a direction perpendicular to the axis A than the stem over a vertical length of the dovetail.

A correspondingly shaped groove or channel in the wall panel (though not shown in detail herein) has a wide docking section configured to fully receive the width of the head into the docking section and, thus, into the wall panel. The vertically oriented dovetail projection can then be slid downward into a second locking or engaging section. The narrower section has a narrower slot opening that is smaller in width than a width of the dovetail head, but sized to accept the width of the stem. The narrower slot opening will retain the head within wider, undercut grooves behind or beneath the narrower slot in the panel. In this configuration, the dovetail projection cannot be pulled forward from the undercut grooves in the wall panel. In one example, the lip 66 shown in FIGS. 2, 3, 5, and 8 will bear against an upward facing exposed stop surface near where the narrower slot opening in the channel begins and thus vertically position the mounting body along the channel.

In one example as depicted in FIGS. 2-9, the disclosed mounting body 60 can be formed from plastic and molded as an integral component. The plastic body 60 can be molded using any suitable process such as, for example, injection molding. The material used to make the body can also vary, but preferably is a substantially rigid plastic material to provide a structurally stabile component for supporting objects on a wall. However, other constructions and materials can be utilized, as is described for the alternative example shown in FIGS. 10-17. Additionally, the configurations, size, and overall look and contour of the mounting body examples disclosed herein can vary considerably and yet fall within the spirit and scope of the invention.

As shown in the example of FIGS. 3 and 5, a contoured depression 98 or receiver can be provided in the rear surface 94 of the mounting body 60. As shown, a depression 98 can be formed on either side of the mounting or dovetail projection near the lower end of the body. These depressions 98 can be formed to receive or snap over bumps (not shown) provided in a channel surface of the wall panel. The depressions 98 and bumps together will form a positive detent that can render a tactile and/or an auditory indication to a user when the mounting body is snapped into place. The detent arrangement can also assist in retaining the mounting body in the installed position on the wall panel. Again, such a groove or channel and slot configuration, and a detent arrangement, are disclosed in the above noted U.S. patents.

Figure 10:
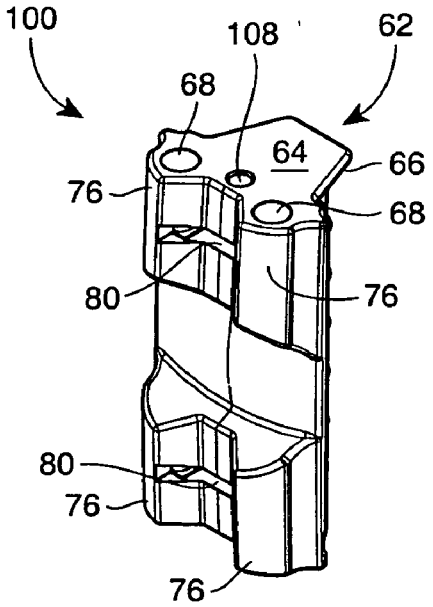
FIG. 10 is a front perspective view of another example of a mounting body constructed in accordance with the teachings of the present invention.

FIGS. 10-17 illustrate another example of a mounting body 100 constructed in accordance with the teachings of the present invention. These figures again illustrate various views and sections of the mounting body 100. FIG. 10 shows a perspective view of the mounting body 100. The body 100 is similar to the body 60 and has a longitudinal axis A, which is typically vertically oriented in use. In this example, the body 100 is a cast aluminum structure, but otherwise has features similar to the body 60. Like components for the body 100 are given like reference numbers in comparison to the body 60.

A top end 62 of the body 100 has a generally flat, truncated, somewhat triangular face 64 in this example. A lip 66 extends rearward at the truncated portion of the face 64 and can acts as a stop or vertical positioner during use. A pair of upward opening connector receptacles or bores 68 extends down into the body 100 from the top face 64. In this example, the bores are again blind and have closed bottom ends.

Figure 17:
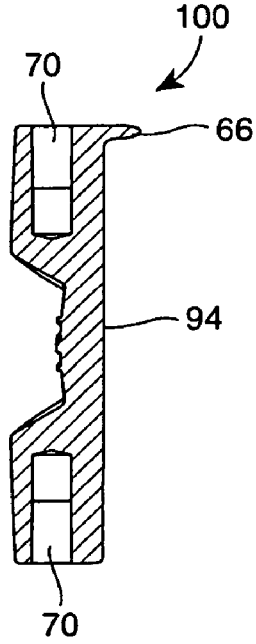
FIG. 17 is a cross section taken along line B-B of the mounting body shown in FIG. 12.

The mounting body 100 has a pair of similarly positioned and spaced apart connector receptacles or bores 70 extending upward in a bottom face 72 of a bottom end 74 of the body. These bottom bores 70 are depicted in cross section in FIG. 17. In this example, as shown in FIGS. 10 and 17, the top and bottom bores 68 and 70 are also provided in protrusions 76 extending forward from the elongate body. Each of the receptacles or bores terminates significantly less than one half the height of the mounting body. The mid-section of the elongate body between the bores has a thinner profile for material savings.

As shown in FIGS. 10, 12, 15, and 16, a pair of forward opening slots or ways 80 is provided in the front of the mounting body 100. As in the prior example, each slot 80 laterally traverses between and partially extends or impinges upon the cylinder of a respective pair of the bores 68 and 70. Each slot or way 80 is configured to receive a slug or key as described below.

Figure 11:
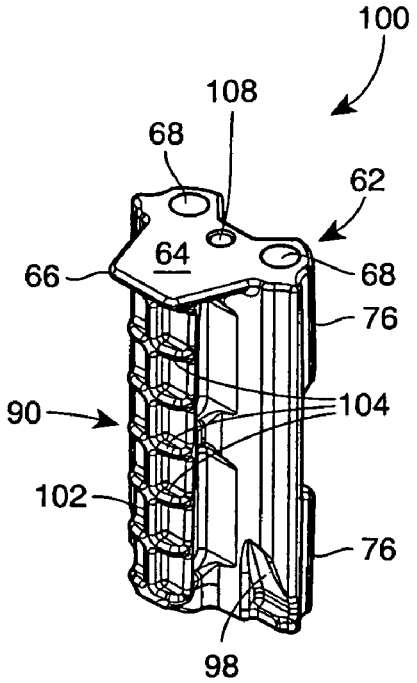
FIG. 11 is a rear perspective view of the mounting body shown in FIG. 10.
Figure 12:
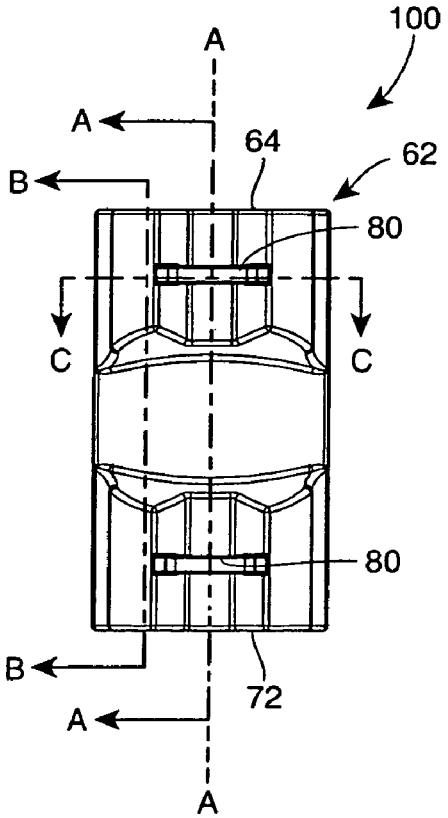
FIG. 12 is a front view of the mounting body shown in FIG. 10.
Figure 13:
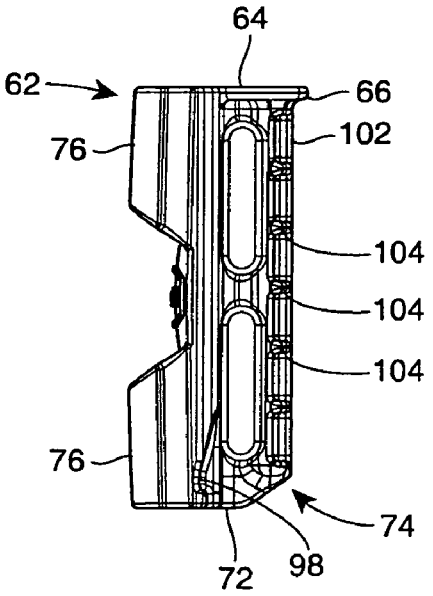
FIG. 13 is a side view of the mounting body shown in FIG. 10.
Figure 14:
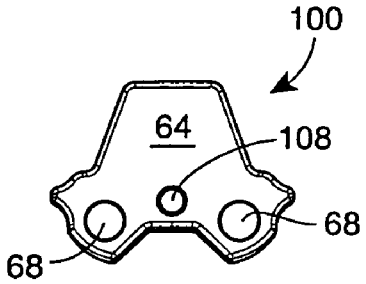
FIG. 14 is a top view of the mounting body shown in FIG. 10.
Figure 15:
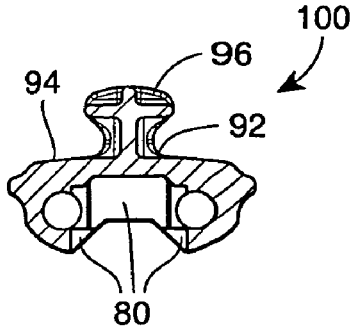
FIG. 15 is a cross section taken along line C-C of the mounting body shown in FIG. 12.

In this example, as shown in FIGS. 11, 13, and 15, each mounting body 100 has a rearward extending projection 90 for slidably mounting the body 100 to a wall panel. In this example, the mounting projection 90 also takes the form of a vertically oriented, elongate dovetail projection that protrudes from the back of the body. The projection is again aligned with the longitudinal axis A of the mounting body 100. The dovetail projection 90 of the body 100 also generally has an elongate stem portion 92 connected to the rear surface 94 of the body. The stem 92 terminates at an elongate head 96 as in the previous example.

In this example, the head 96 has a different look and structure, but retains the overall outer contour. The head 96 of the body 100 has an elongate longitudinally aligned spine 102 and a plurality of laterally extending ribs 104. The spine and ribs define the outer contour of the head and match that of the solid head 96 of the plastic body 60. The spine and ribs in this example permit material reduction to save weight and aluminum cost, and yet add rigidity and strength to the part.

The mounting body 100 as shown in the example of FIGS. 11 and 13 also has contoured depressions 98 near the lower end of the body. These depressions 98 can be formed to receive or snap over bumps (not shown) provided in a channel surface of the wall panel.

Figure 16:
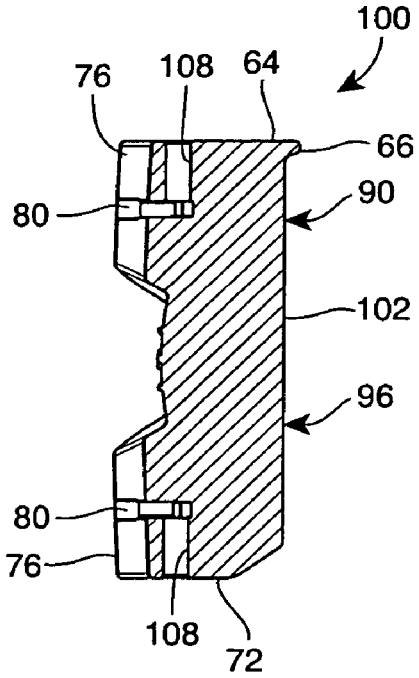
FIG. 16 is a cross section taken along line A-A of the mounting body shown in FIG. 12.

The mounting body 100 also has another feature briefly mentioned above. In this example, a set screw opening 108 is shown in FIGS. 10 and 11 and is formed in each of the top and bottom faces 64 and 72. As shown in FIG. 16, a set screw opening 108 opens into each of the slots 80. The openings 108 are threaded to receive a like threaded fastener or set screw 10 to assist in holding the slugs in place when installed, as is described below (see FIGS. 21 and 23, each of which depicts the set screw 10).

The disclosed mounting bodies 60 and 100 are just two of many possible examples. As will become apparent upon reading this disclosure, the bodies need only have in some instances only an upper pair or a lower pair of bores 68 or 70, respectively. Alternatively or in addition, each mounting body may include only a single bore 68 and/or 70 in either end of the body. In such an example, the accessory device would have only a single prong or connector for attaching to the mounting body. Such a construction falls within the spirit and scope of the present invention. However, the disclosed dual upper and dual lower bore body configuration provides mounting stability and modular adaptability to the disclosed system and apparatus.

Figure 18:
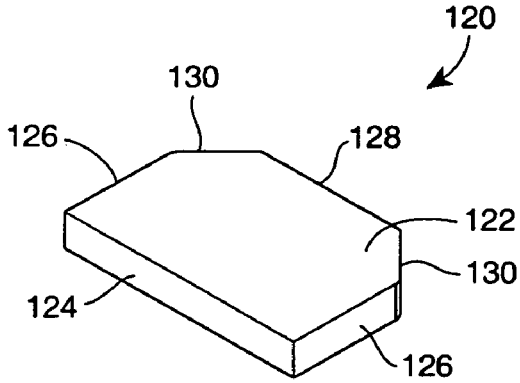
FIG. 18 is a perspective view of one example of a slug for use with the mounting bodies shown in FIGS. 2 and 10.

FIG. 18 shows one example of a releasable retainer in the form of a slug 120 or key that is slidable into the slots 80 of the mounting bodies 100 and 60. The slug in this example is a flat, planar plate and can be formed of any suitable material such as steel, aluminum, plastic, or the like. In this example, the slug 120 has a body 122 with a thickness that is thinner than its width and depth. The slug 120 has a flat front end 124, a pair of flat sides 126, a flat back end 128, and a pair of angled rear corners 130. A slug 120 is slid into each of the slots 80 of the bodies to secure and retain the mounting bodies to an accessory device as described below.

The releasable retainers need not be flat plate slugs, but instead could take on many other non-flat or even round or cylindrical shapes. Additionally, the slots 80 could be eliminated and one or more retainers could be provided directly with the mounting bodies. Such retainers could be biased to a protruding position in which they would seat in the grooves of the connectors or prongs described below. These types of retainers could automatically snap into place when the connectors or prongs are inserted into the mounting body.

Any number of storage devices or accessories can be provided for mounting to a wall panel such as the panel 50. Each of these devices or accessories is provided with pairs of attachment prongs or connectors that are spaced apart and configured for easy insertion into selected ones of the receptacles or bores in the mounting bodies. A number of possible accessory examples are shown in FIG. 1. A first one of those examples is a long handled tool rack assembly 200, which is shown in more detail in FIGS. 19-24.

Figure 19:
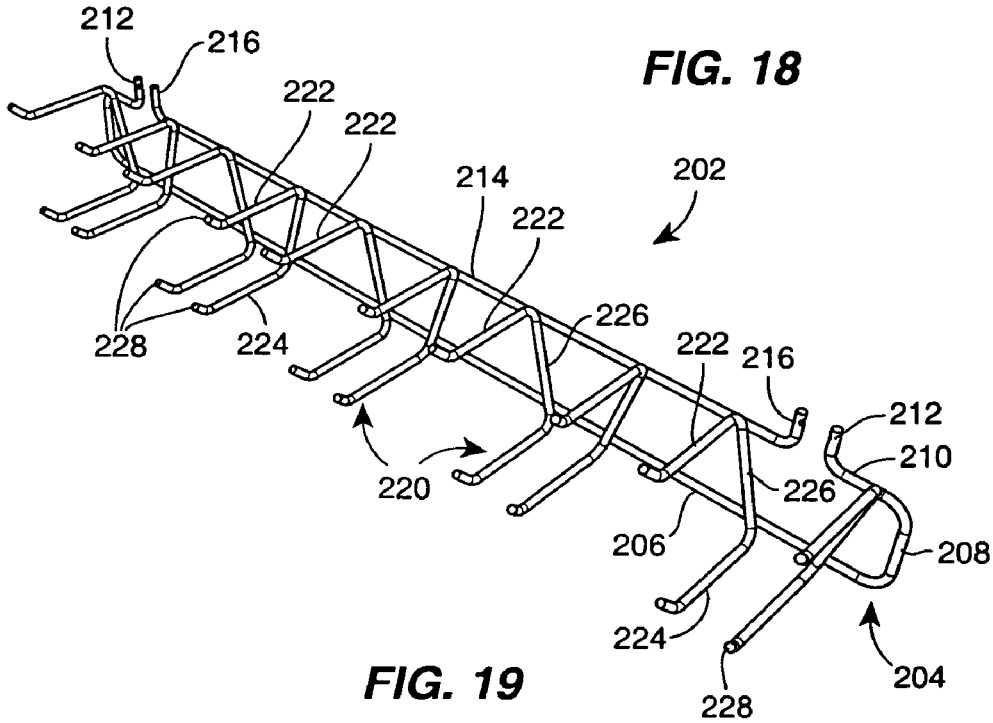
FIG. 19 is a perspective view of one example of an accessory device for use with the mounting bodies and slug shown in FIGS. 2-18.

FIG. 19 shows a perspective view of a long handled tool rack 202 constructed in accordance with the teachings of the present invention is illustrated. The tool rack accessory 202 disclosed in this example is formed of bent wire. The rack accessory 202 has an elongate, generally rectangular base section 204. The base section has a horizontally oriented bottom wire 206 with ends that bend into a pair of generally upwardly extending end wires 208. The end wires 208 bend inward toward one another and terminate at a pair of outer top wires 210. End sections of the outer top wires 210 terminate at upturned ends, each forming an outer connector or prong 212. One outer connector or prong 212 is thus formed near each end of the rack accessory 202.

A central top wire 214 is positioned extending between the outer prongs 212 and is aligned with the outer top wires 210. The distal ends of the central top wire 214 also terminate at upturned ends, each creating one inner connector or prong 216 that is near but spaced inward from a respective one of the outer prongs 212. Pairs of connectors or prongs are formed by one of the inner and outer prongs 216 and 212. In this example, two pairs of upturned prongs or connectors 212 and 216 are provided on a top end of the long handled tool rack accessory 202. Each connector pair is spaced apart and oriented so as to align with and slide into a pair of bottom bores 70 in amounting body 60 or 100. Alternatively, each pair attachment prongs or connectors 212 and 216 in this example can instead be oriented downward to be inserted into a pair of top bores 68 in a mounting body.

The disclosed long handled tool rack accessory 202 has a plurality of generally C-shaped support wires or hooks 220 attached via welding to and extending forwardly from the base wire 204. Each of the C-shaped support wires 220 has a horizontal top wire 222, a horizontal bottom wire 224 spaced beneath the top wire, and a rear vertical wire 226 connecting the top and bottom wires. The rear wire 226 are also attached, such as by welding, to the top and bottom wires of the larger base wire 204.

In this example, each of the forward ends of the C-shaped support wires has an upturned tip 228. These tips can assist in retaining a head of a long handled tool that is resting on either the top or the bottom support wires by inhibiting the tool head from sliding forward off the support wires. Also in this example, a tool head for a long handled tool can be placed to rest either between the top and bottom wires of the C-shaped hooks to be supported by the bottom wire, or on the top wires.

Also as disclosed in this example, the C-shaped support wires or hooks 220 are arranged in alternating angled orientations and can be described as being in pairs. Each pair of the C-shaped wires 220 is tilted sideways at an angle relative to vertical. Thus, in this example, the top wires 222 are shown equally spaced along the accessory rack 202. The bottom wires 224 alternate between being closer together and further apart relative to adjacent bottom wires. The top wires 222 in this example create a wider support base for a tool head. The closely spaced bottom can be used to capture a handle of a tool stored in the rack accessory.

As will be evident to those having ordinary skill in the art, the long handled tool storage rack accessory 202 shown in FIG. 19 is only one of many possible accessory device examples that can fall within the spirit and scope of the present invention. The C-shaped support wires can vary from that disclosed and need not be C-shaped at all. Further, the number of tool supports can vary considerably as well. The spacing and/or angle between pairs of the C-shaped support wires can vary, and a variety of different tool supports can be provided on the overall accessory device, if desired. The number of attachment prongs can also vary from the two pairs as shown. The more attachment prongs provided, the more support, and thus the heavier load bearing capacity for a given device.

Figure 20:
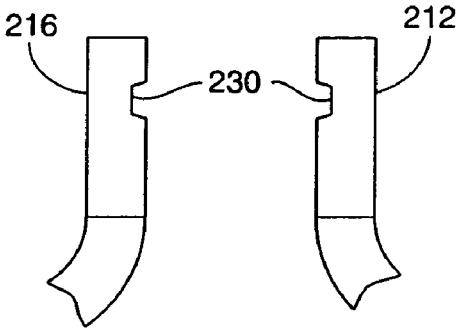
FIG. 20 is an enlarged front view of one pair of accessory connectors on the accessory device shown in FIG. 19.

FIGS. 20-24 illustrate one example of a structure and arrangement for securing a mounting body, such as a body 100, to an accessory device, such as the rack accessory 202. FIG. 20 shows an enlarged front view of one pair of prongs 212 and 216. Each prong has a groove 230 cut into a side surface. The grooves 230 are opposed and face one another across the gap between the prongs. In this example, the grooves 230 are formed to fit the shape and thickness of an edge of the slug 120.

Figure 21:
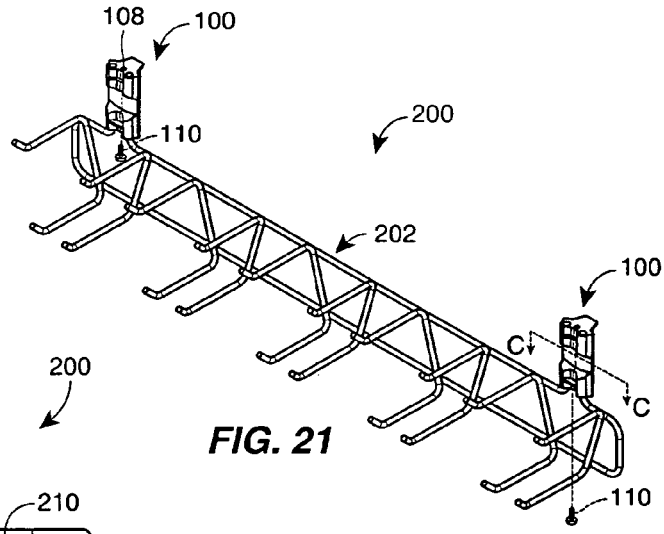
FIG. 21 shows a perspective view of an assembly including the accessory device shown in FIG. 19 and a mounting apparatus.
Figure 22:
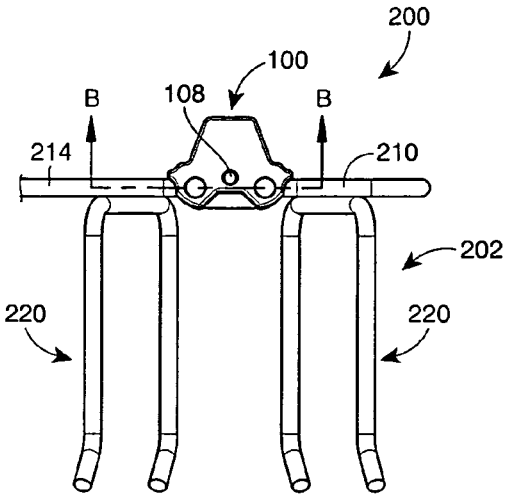
FIG. 22 shows a top view of a right hand corner portion of the assembly shown in FIG. 21.
Figure 23:
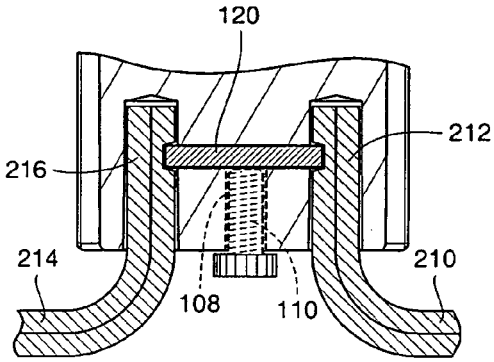
FIG. 23 is a cross section taken along line A-A of the assembly shown in FIG. 22.
Figure 24:
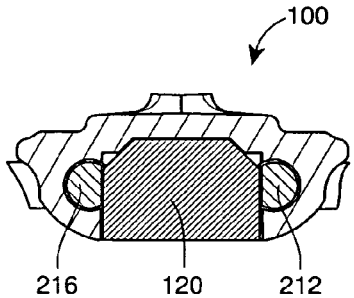
FIG. 24 is a cross section taken along line C-C of the assembly shown in FIG. 21.

FIG. 21 generally shows the rack assembly 200 with a mounting body 100 attached to each pair of prongs 212 and 216. FIG. 22 shows a top view of the right hand side of the assembly 200 in FIG. 21. FIG. 23 shows a vertical section and FIG. 24 shows a horizontal section of the installed mounting body 100. The mounting body 100 is slid onto the accessory 202 with the prongs 212 and 216 received in the bottom bores 70. The grooves 230 in the prongs align with the slot 80 in the lower end of the body 100. The slug 120 is slid rearward into the slot. Side edges of the slug slide into the grooves 230 and thus prevent the prongs from backing out of the bores 70.

As depicted in FIG. 23, the body 100 has a set screw opening 108 for receiving a set screw 110. Once a slug 120 is in place in a slot 80, the set screw can be installed and tightened to bear against a bottom surface of the slug 120 in this example. The earlier described body 60 does not employ set screws to hold the slugs in place.

Figure 25:
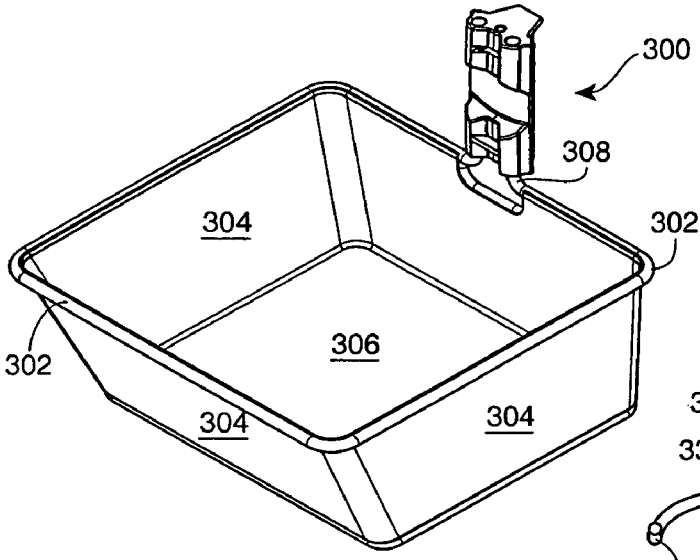
FIG. 25 is a perspective view of another example of an assembly wherein the accessory device is a storage container.

FIG. 25 illustrates another accessory device option. In this example, the accessory device and mounting apparatus assembly is a storage container or basket assembly 300. The basket assembly 300 includes a wire structure or frame 302 that is generally rectangular in this example and oriented horizontally. The frame 302 has a top opening and supports a basket side wall 304 and bottom wall 306 suspended from the frame. A rear side of the frame 302 has a pair of centrally located, upstanding prongs 308 or connectors that are identical to those described in the prior tool holder assembly 250 example. The basket assembly 300 is illustrated having a mounting body with its bottom bores coupled to the connectors as previously described and shown in FIGS. 10-17. The basket assembly 300 can be mounted to a wall panel in a manner identical to that for the previously described tool holder assembly 250.

Figure 26:
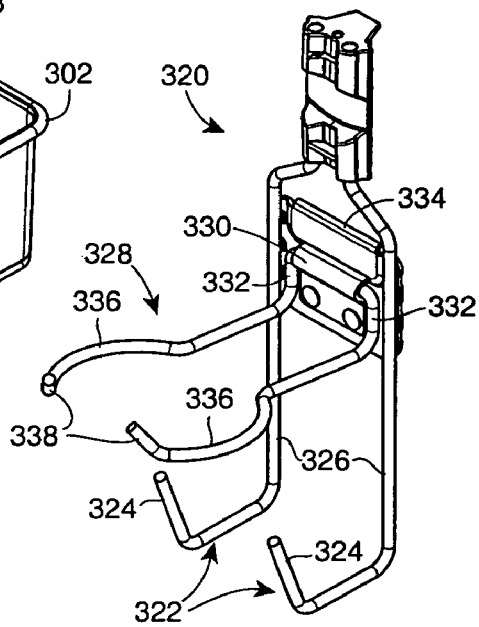
FIG. 26 is a perspective view of another example of an assembly wherein the accessory device is a combination support hook and tool holder.

FIG. 26 illustrates another example of an accessory device and mounting apparatus combination. In this example, the accessory device is a wire form hook and tool holder assembly 320. The hook and tool holder assembly 320 has a wire form dual hook arrangement with a pair of laterally spaced apart hooks 322. Each of the hooks has an upturned forward end 324 and a rear support wire 326 extending upward. The rear support wires angle inward near their top ends. The top ends of the support wires terminate at prongs or connectors that are identical to those previously described herein. The connectors or prongs are received in the bottom bores of a previously described mounting body and secured therein by a slug, also as previously described.

In this example, the tool holder and hook assembly also includes a forward extending, horizontally oriented tool holder 328. The tool holder includes a continuous wire with a mid-portion pivotally supported by and retained in a retainer 330 on the plate. The retainer 330 permits the tool holder to pivot upward and return to the horizontal position. A pair of downward depending wire sections 332 depend from opposite sides of the mid-portion and bear against a plate 334 secured between the two support wires 326 of the dual hooks 322. The plate 334 assists in providing stability to the structure and also acts as a stop plate for the tool holder. A pair of wires extend forward from the downturn sections 332 and continue into arcuate and opposed tool holder wires 336. The distal ends of the arcuate tool holder wires 336 terminate at upturned tips 338. The upturned tips 338 of the holders and the ends 324 of the dual hooks assist in retaining objects supported, suspended, or otherwise retained in the tool holder 328 or dual hooks 322.

Figure 27:
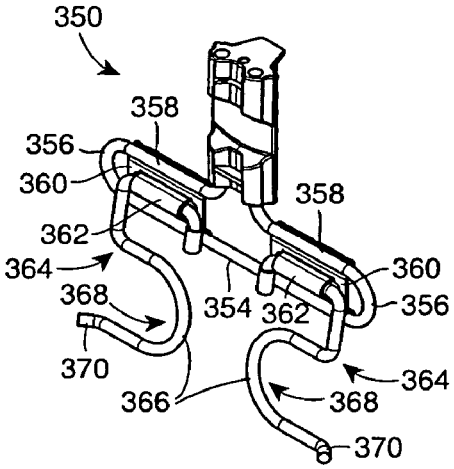
FIG. 27 is a perspective view of another example of an assembly wherein the accessory device is a dual tool holder.

FIG. 27 shows yet another example of an accessory device and mounting apparatus assembly. In this example, the accessory device is a long handled tool support assembly 350. The tool support assembly 350 is also of a wire form construction and has a support loop 352 with a continuous bottom wire 354 and curved sides 356. The sides 356 curve back parallel to the bottom wire to form a pair of top wires 358 spaced upward from the bottom wire. The top wires continue toward one another, then bend upward and terminate at prongs or connectors constructed identically to those previously described. The prongs or connectors are received again in the bottom bores of a mounting body as shown in FIGS. 10-17 and described previously.

The tool holder assembly 350 in this example has a pair of support plates 360 positioned on either side of the loop 352 and connected to both the top wires 358 and the bottom wire 354. Each support plate 360 includes a pivotal hinge cylinder or retainer 362 facing forward and mounted to the plate 360. Each retainer 362 in this example is positioned generally parallel to the top and bottom wires. One end of an S-hook 364 is pivotally supported in each of the hinge cylinders or retainers 362. Each S-hook can be raised and lowered freely by pivoting relative to the hinge cylinder. Each S-hook 364 has a forward hook portion 366 that is open facing outward. The hook portions 366 defines opposed, outward facing, long handled tool receptacles 368 and have distal ends that terminate at an upturned tip 370. When supporting a long handled tool, its tool head, such as a shovel or rake, will bear against the hook portion 366. The respective tip 370 will abut against a portion of the tool head to assist in preventing the tool from sliding laterally outward from the handle receptacle.

Figure 28:
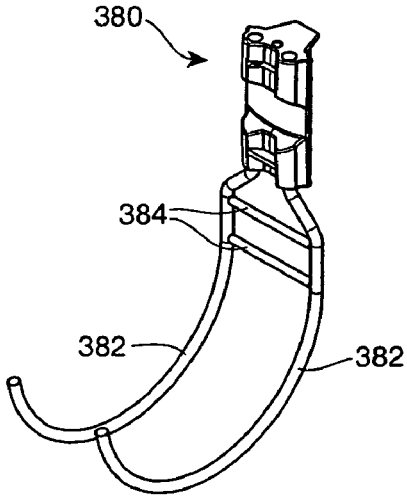
FIG. 28 is a perspective view of another example of an assembly wherein the accessory device is a dual hook configuration.

FIG. 28 illustrates yet another example of a storage accessory and mounting apparatus assembly. In this example, the storage accessory is a dual hook assembly 380. As with the prior examples, the dual hook assembly 380 in this example has a pair of upward extending prongs or connectors received in the bottom bores of a mounting body as previously described. The prongs or connectors in this example extend downward and outward into a pair of forward extending J-hooks 382. The J-hooks 382 are spaced apart and interconnected near their rear ends by a pair of transverse structural wires 384 to add rigidity and structural stability to the assembly 380. The prongs or connectors again are received in the bottom bores of a mounting body as previously described and shown.

Figure 29:
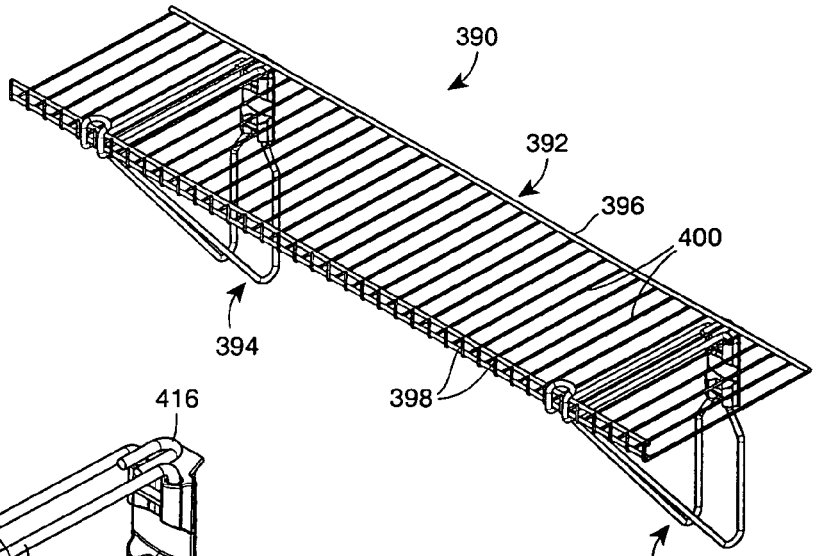
FIG. 29 is a perspective view of another example of an assembly wherein the accessory device is a wire shelf assembly.
Figure 30:
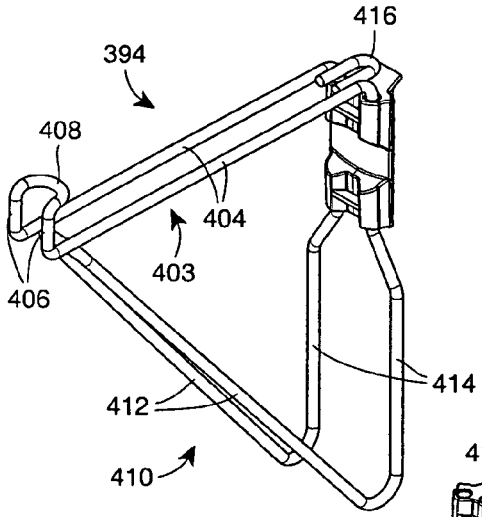
FIG. 30 is a perspective view of an assembled shelf support bracket and mounting apparatus of the wire shelf assembly shown in FIG. 29.

FIGS. 29 and 30 illustrate yet another example of an accessory device and mounting apparatus assembly. In this example, the accessory device is in the form of a wire shelf assembly 390. The wire shelf assembly includes a shelf 392 and a pair of support bracket assemblies 394. The shelf 392 in this example is a typical wire shelf with a back wire 396 and a pair of front wires 398 extending generally parallel to and spaced forward from the back wire. The pair of front wires 398 are spaced apart from one another with one positioned above the other in this example. A plurality of shelf surface wires 400 are positioned adjacent and spaced apart from one another along and perpendicular to a length of the shelf 392. The shelf wires 400 extend between and interconnect the back wire 396 and front wires 398.

FIG. 30 illustrates a perspective view of one of the two shelf bracket assemblies. Each of the bracket assemblies 394 is connected to and supported by a mounting body as described previously and shown in FIGS. 10-17. In this example, the support bracket assemblies include a wire form bracket 402. The bracket 402 as an upper part and a lower part. The upper part 403 has two forward extending top wire sections 404 with down turned rear ends that form a first pair of the prongs or connectors as previously described. This pair of prongs are received in the top bores of the mounting body, also as previously described. The top wire sections 404 terminate and join at an upturned, continuously curved front end. Each of the top wires 404 has an upturned front section. Each of these sections continues, bends rearward, and meets one another to form a rearward extending loop 408. The loop 408 and front sections 406 are sized to receive the spaced apart front wires 398, which rest on the top wires 404 of the bracket beneath the loop 408.

Each bracket 402 also includes a lower part 410. The lower part 410 has a pair of angled load bearing sections 412 which are spaced apart from one another. Each of the angled sections 412 transitions at its rear end into an upward extending vertical wire section 414. These sections are bent near their top ends and form a second pair of the prongs or connectors as previously described. This pair of prongs is received in the bottom bores of a mounting body, also as previously described. The forward and upward ends of the angled sections 412 continue into a loop that is welded to the bottom surface of the top wires 404 of the upper part 403. As shown in FIG. 29, the shelf rests on the top wires 404 and its weight, along with items stored on the support surface of the shelf, are supported by the angled load bearing sections 412.

In this example, a U-shaped loop 416 is positioned between the pair of top wires 404 near their rear ends and welded to their respective inner surfaces. This loop 416 encompasses an opening 417 (see FIG. 31 for an example) in the top face of the mounting body in this example. A fastener can be received through this U-shaped loop 416 to assist in securing the bracket assembly 394 to the mounting body.

Figure 31:
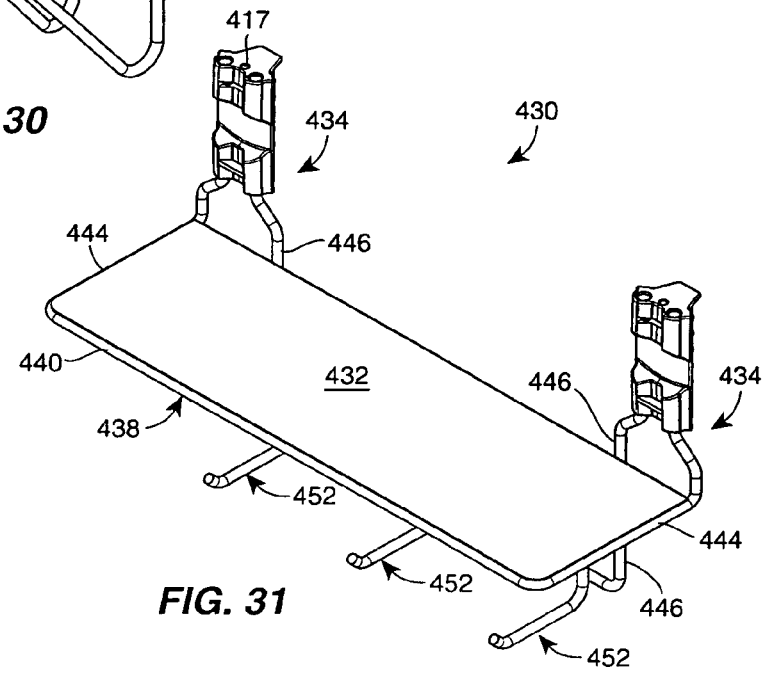
FIG. 31 is a perspective view of another example of an assembly wherein the accessory device is a combination shelf and support hook configuration.
Figure 33:
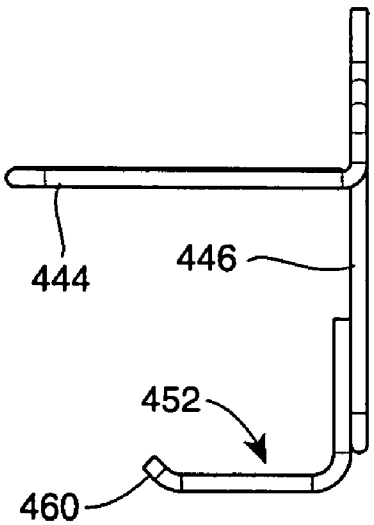
FIG. 33 is a side view of the assembly shown in FIG. 31.
Figure 32:
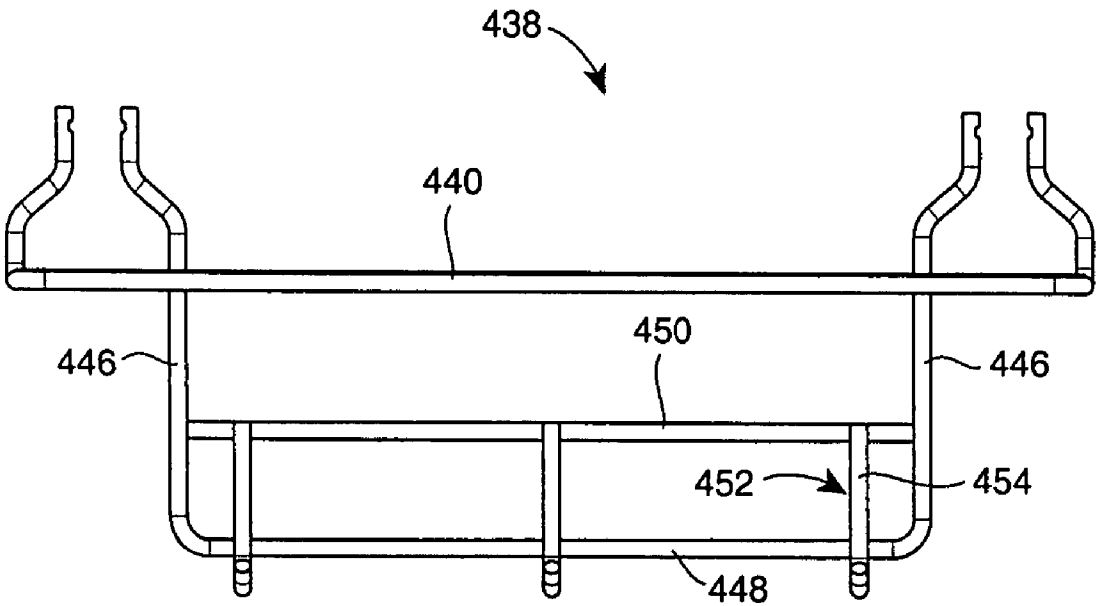
FIG. 32 is a front view of the assembly shown in FIG. 31.

FIG. 31 illustrates still another example of an accessory device and mounting apparatus assembly. In this example, the accessory device is a storage shelf 430 with a solid shelf support surface 432. The shelf assembly 430 is supported by a support bracket assembly 434 more clearly shown in FIGS. 32 and 33. The support bracket assembly 434 is supported by a pair of the previously mounting bodies. Again, in this example the support bracket assembly includes a wire form structure 438 of a generally rectangular horizontal bent wire configuration that supports the solid shelf surface 432. The rectangular wire 438 includes a front-wire 440 and a pair of side wires 444. Each of the side wires 444 at its rear end is upturned and then bent inward to terminate at a single prong or connector received in an outermost bottom bore of a respective one of the mounting bodies.

Each of the mounting bodies has a second prong or connector received in the innermost bottom bores. These prongs are part of wires that extend downward and include a vertical section 446. Each then bends toward and joins the other to form a continuous lower cross wire 448. A transverse wire 450 is attached or welded to the vertical sections and spaced upward from and parallel to the cross wire 448 in this example. Three J-shaped hooks 452 have a vertical section 454 extending between and welded to both the cross wire and transverse wire. The J-shaped hooks also have a forward extending support wire 458 and an upturned tip 460.

A number of alternative and optional accessory devices are disclosed herein. The accessory devices disclosed herein are not intended to be limiting in any way. Other accessory devices that utilize the mounting apparatus and system of the present invention are also within the purview of the present invention. This disclosure is not intended to be limited only to those structures and examples disclosed herein.

The accessory device structures are shown herein to be circular cross section wire form constructions. Other constructions and configurations can be utilized. The prongs or connectors need not be circular in cross section and need not be formed of wire or even metal. The prongs or connectors can instead be square, rectangular, or other shaped in cross section. The bores or receptacles in the mounting bodies need only accommodate the selected shape.

Similarly, the slug need not be a flat plate or even planar in construction. The slugs can be cylinders or some other shaped components. The slugs need only fit the corresponding shapes of the mounting body slot and connector grooves. The slug can be made of any suitable material. Additionally, two or more slugs can be utilized for each mounting body if desired.

The dual attachment, dual bore, dovetail mounting bodies disclosed herein essentially provide a universal mounting system and apparatus. The mounting bodies can accept and support any number of storage accessories, as long as the accessory is configured to connect to the mounting body. One must simply attach the necessary number of mounting bodies to a selected storage device or other accessory and mount the assembly to a wall panel. If one wishes to change accessories, one can easily detach an accessory from wall panel, remove the mounting bodies, and swap the device or accessory for another as desired. Additionally, the assemblies disclosed herein can be moved and mounted virtually anywhere on the wall panel, as long as a mounting groove or channel is present.

It will be apparent that the various wire configurations can be varied considerably from the examples shown and described herein. A wide variety of storage and other accessories can be provided for the consumer to adapt their storage environment, such as a storage shed, to their needs. The disclosed dual attachment dovetail mounting bodies and storage accessories can be utilized with presently known BIG MAX shed structures provided and sold by Rubbermaid, Inc., the assignee of the present disclosure. These BIG MAXX structures incorporate wall panels adapted for use with the dovetail projections of the mounting bodies disclosed herein. These structures are disclosed in the previously mentioned issued patents.

For the purposes of the present invention, the mounting projections on the mounting bodies need not be dovetail-type structures. Instead, other types of mounting projections and wall panel surface configurations can also be used for connecting the mounting bodies to a wall panel, if desired.

For lighter loads, a more cost efficient solution could be used whereas a more costly solution could be provided for more versatility and to support more weight. As mentioned above, more than two prong or connector attachment locations could be provided on the mounting bodies, or only one attachment location could be provided. Also as noted previously, only a top or a bottom attachment location or locations could be provided on each mounting body, as desired.

The limitations in weight capacity of the wall mounting surface will affect the load capacity of a given application. The maximum adaptability and load capacity for each installation can vary depending on the needs of a given application.

The universal nature and optional mounting locations of the disclosed dovetail mounting apparatus and system allow for multiple attachment points for accessories. This creates, in this specific case, better utilization of the existing storage space and significant flexibility to the consumer for arranging their storage space.

Although certain storage device and accessory mounting systems, apparatuses, and configurations have been described herein in accordance with the teachings of the present disclosure, the scope of coverage of this patent is not limited thereto. On the contrary, this patent covers all embodiments of the teachings of the disclosure that fairly fall within the scope of permissible equivalents.

What is claimed is:

1. A mounting apparatus comprising:

a wall panel accessory having a pair of prongs that extend from a portion of the accessory, each prong of the pair of prongs having a groove, each of the grooves oriented such that the grooves face one another;

a mounting body having a front and a back, the mounting body including a slot;

a pair of bores extending into a surface of the body and intersecting the slot, the pair of prongs sized to be received in the pair of bores;

a releasable retainer sized to protrude into the slot and engage the groove on each prong of the pair of prongs, wherein the releasable retainer is a slug slidably received in the slot; and a wall mounting projection extending from the back of the body and configured to slidably mount in a channel in a wall panel.

2. A mounting apparatus according to claim 1, wherein:

the pair of bores extend vertically into a top end or a bottom end of the body.

3. A mounting apparatus according to claim 1, wherein the slug is a generally flat plate.

4. A mounting apparatus according to claim 1, wherein the mounting body is a molded plastic component or a cast metal component.

5. A mounting apparatus comprising:

a wall panel accessory having at least one connector that projects from a portion of the accessory and having a groove formed in a surface of the connector;

a mounting body having a front and a back;

at least one connector receptacle extending into a surface of the body, the at least one connector releasably received in the connector receptacle;

a releasable retainer protruding into the groove of the connector; and a wall mounting projection extending from the back of the body and configured to slidably mount in a channel in a wall panel; and wherein the wall mounting projection is an elongate dovetail projecting rearward from the back of the mounting body, the dovetail having a stem extending generally parallel to a longitudinal axis of the mounting body and a head carried on an end of the stem and spaced from the back of the mounting body, the head having a width in a direction perpendicular to the longitudinal axis of the mounting body that is greater than a width of the stem.

6. A mounting apparatus according to claim 5, wherein the at least one connector further comprises a pair of the wire prongs spaced apart and generally parallel to one another, each of the wire prongs having a groove formed in a surface of the connector, the grooves opposing and facing one another.

7. A mounting apparatus comprising:

a wall panel accessory having at least one connector that projects from a portion of the accessory and having a groove formed in a surface of the connector;

a mounting body having a front and a back;

at least one connector receptacle extending into a surface of the body, the at least one connector releasably received in the connector receptacle;

a releasable retainer protruding into the groove of the connector; and a wall mounting projection extending from the back of the body and configured to slidably mount in a channel in a wall panel;

and further comprising:

a pair of connector receptacles extending into each of a top end and a bottom end of the body;

a pair of retainer receiving slots formed into the front of the body, each slot opening into a portion of one of the pairs of connector receptacles; and a set screw opening positioned between each pair of connector receptacles in the top end and the bottom end of the body, each set screw opening having a bottom end that opens into a respective one of the slots.

8. A mounting apparatus for mounting accessories to a wall panel, the mounting system comprising:

at least one wall panel accessory having a pair of elongate connectors projecting from a portion of the accessory, the pair of elongate connectors arranged spaced apart from and generally parallel to one another;

a pair of grooves, one in each of the elongate connectors and positioned to oppose and confront one another;

a mounting body with a front side, a back side, a top end, and a bottom end;

a pair of receptacles spaced apart and recessed into one end of the body and extending generally parallel to one another, each receptacle configured to receive one of the elongate connectors;

a slot extending into the front side of the mounting body, a portion of the slot opening into each of the pair of receptacles;

a slug slidable into and out of the slot and sized and shaped such that a part of the slug can extend into and intersect each of the pair of receptacles when the slug is fully seated in the slot and extend into each of the grooves in the pair of connectors when received in the pair of receptacles; and a wall panel connector extending from a part of the mounting body.

9. A mounting apparatus according to claim 8, wherein the at least one wall panel accessory has at least two pairs of elongate connectors projecting from a portion of the accessory, and wherein each elongate connector of the pairs of connectors is a wire prong.

10. A mounting apparatus according to claim 8, further comprising:

a pair of spaced apart receptacles in each of the top end and the bottom end of the mounting body, each receptacle of a pair of receptacles extending generally parallel to the other receptacle of that pair.

11. A mounting apparatus according to claim 8, wherein the pair of receptacles are formed as a pair of blind bores into one end of the body, each of the blind bores including a generally circular cylindrical cross section.

12. A mounting apparatus according to claim 11, wherein the pair of elongate connectors are a pair of circular cross section wire prongs.

13. A mounting apparatus for mounting accessories to a wall panel, the mounting system comprising:

at least one wall panel accessory having a pair of elongate connectors projecting from a portion of the accessory, the pair of elongate connectors arranged spaced apart from and generally parallel to one another;

a pair of grooves, one in each of the elongate connectors and positioned to oppose and confront one another;

a mounting body with a front side, a back side, a top end, and a bottom;

a pair of receptacles spaced apart and recessed into one end of the body and extending generally parallel to one another each receptacle configured to receive one of the elongate connectors;

a slot extending into the front side of the mounting body, a portion of the slot opening into each of the pair of receptacles;

a slug slidable into and out of the slot and sized and shaped such that a part of the slug can extend into and intersect each of the pair of receptacles when the slug is fully seated in the slot and extend into each of the grooves in the pair of connectors when received in the pair of receptacles; and a wall panel connector extending from a part of the mounting body; and wherein the at least one wall panel accessory is a storage device including a plurality of wire form hooks.

14. A mounting apparatus for mounting accessories to a wall panel, the mounting system comprising:

at least one wall panel accessory having a pair of elongate connectors projecting from a portion of the accessory, the pair of elongate connectors arranged spaced apart from and generally parallel to one another;

a pair of grooves, one in each of the elongate connectors and positioned to oppose and confront one another;

a mounting body with a front side, a back side, a top end, and a bottom;

a pair of receptacles spaced apart and recessed into one end of the body and extending generally parallel to one another, each receptacle configured to receive one of the elongate connectors;

a slot extending into the front side of the mounting body, a portion of the slot opening into each of the pair of receptacles;

a slug slidable into and out of the slot and sized and shaped such that a part of the slug can extend into and intersect each of the pair of receptacles when the slug is fully seated in the slot and extend into each of the grooves in the pair of connectors when received in the pair of receptacles; and a wall panel connector extending from a part of the mounting body; and wherein the wall panel connector is an elongate dovetail projecting from the back of the mounting body and extending along a longitudinal axis of the mounting body and having a stem extending generally parallel to the longitudinal axis and a head carried on an end of the stem spaced from the back of the mounting body, the head having a width in a direction perpendicular to the longitudinal axis of the mounting body that is greater than a width of the stem.

15. A mounting apparatus according to claim 8, further comprising:

a plurality of different ones of the wall panel accessories, each selectable by a user; a plurality of the mounting bodies; and a plurality of the slugs, wherein any one of the plurality of the mounting bodies and the slugs is configured to connect to the pair of elongate connectors on any one of the selectable wall panel accessories.

16. A wall mountable storage device and mounting system comprising:

a plurality of storage devices mountable to a wall panel and selectable by a user, each of the plurality of storage devices having at least a pair of elongate prongs extending from a portion of the storage device, each pair of elongate prongs being spaced apart from and generally parallel to one another;

a pair of grooves in each of the pairs of elongate prongs, each groove of each pair positioned opposite and confronting the other groove of each pair;

a mounting body with a front side, a back side, a top end, a bottom end and a longitudinal axis;

a pair of bores spaced apart and extending into at least one of the top end or the bottom end of the mounting body, the pair of bores generally parallel both to one another and to the longitudinal axis of the mounting body, each of the pair of elongate prongs received in a respective one of the pair of bores;

an elongate slot in the front side of the mounting body oriented generally perpendicular to the longitudinal axis of the mounting body, a portion of the slot opening into each of the pair of bores;

a slug slidably received in the slot and sized and shaped such that part of the slug intersects each of the pair of bores and are positioned within each of the grooves in the pair of prongs; and a wall panel connector extending rearward from the back of the mounting body.

17. A mounting apparatus comprising:

a wall panel accessory having at least two pair of prongs projecting from a portion of the accessory, each prong of the at least two pair of prongs having a groove, each of the grooves oriented such that the grooves of each pair of prongs face one another;

a mounting body having a front and a back, the mounting body including a slot;

a pair of bores extending into a surface of the body and intersecting the slot, the pair of prongs sized to be received in the pair of bores;

a releasable retainer sized to protrude into the slot and engage the groove on each of the pair of prongs; and a wall mounting projection extending from the back of the body and configured to slidably mount in a channel in a wall panel.

* * * * *